US006203665B1

(12) United States Patent
Begemann

(10) Patent No.: US 6,203,665 B1
(45) Date of Patent: Mar. 20, 2001

(54) PROCESS FOR SETTING A UNIFORM CHARACTERISTIC CROSS-DIRECTION PROFILE FOR A PAPER WEB

(75) Inventor: Ulrich Begemann, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/366,650

(22) Filed: Aug. 4, 1999

(30) Foreign Application Priority Data

Aug. 5, 1998 (DE) ..... 198 35 295

(51) Int. Cl.[7] ..... D21F 11/00

(52) U.S. Cl. ..... 162/198; 162/216; 162/208; 162/DIG. 10; 162/DIG. 11; 162/252; 162/253; 162/258; 162/336; 162/344; 162/183; 162/164.6; 702/127

(58) Field of Search ..... 162/DIG. 10, DIG. 11, 162/198, 208, 216, 336, 344, 252, 253, 258, 259, 262, 263, 183, 164.6; 702/127, 128, 129

(56) References Cited

U.S. PATENT DOCUMENTS 4,898,643 * 2/1990 Weisshuhn ..... 162/259
5,560,807 * 10/1996 Hauser ..... 162/183
5,944,957 * 8/1999 Fagerlund ..... 162/258

FOREIGN PATENT DOCUMENTS 4239845 5/1993 (DE) .

OTHER PUBLICATIONS

Begemann, "Module Jet®: The New Headbox for Independent Control of Cd Basis Weight and Fiber Orientation Profiles," (Mar. 1994).

Begemann, "Module Jet—erste Betriebserfahrungen mit dem neuen Stoffauflaufkonzept," *Wochenblatt für Papierfabrikation*, 112, No. 12, pp. 485–491 (1994).

Wurster et al., "Stoffdichteabhängige Querprofilregelung–Betriebserfahrungen," *Das Papier*, vol. 49, issue 10A, pp. V99–V105 (1995).

Heinzmann, "Faserorientierungs–Querprofil," *Wochenblatt für Papierfabrikation*, No. 4, pp. 121–126 (1995).

* cited by examiner

*Primary Examiner*—Stanley S. Silverman
*Assistant Examiner*—Mark Halpern
(74) *Attorney, Agent, or Firm*—Greenblum & Bernstein, P.L.C.

(57) ABSTRACT

Process for setting a uniform characteristic cross-direction profile for a paper web with regard to at least formation, basis weight, and fiber orientation in a paper machine. The paper machine can include a headbox with an adjustable die exit opening and within which the consistency is sectionally adjustable. The process includes measuring and setting a desired basis weight cross-direction profile by adjusting the sectional consistency in the headbox, adjusting the formation cross-direction profile by adjusting a sectional, specific pulp slurry flow rate at the die exit opening, and one of enlarging the die exit opening at positions along a width of the paper machine in which a pulp slurry flow rate is higher than in other positions along the width of the paper machine and increasing the pulp slurry flow rate for positions along the width at which the die exit opening is larger than at other positions along the width. In this manner, a desired fiber orientation cross-direction profile is attained.

20 Claims, 1 Drawing Sheet

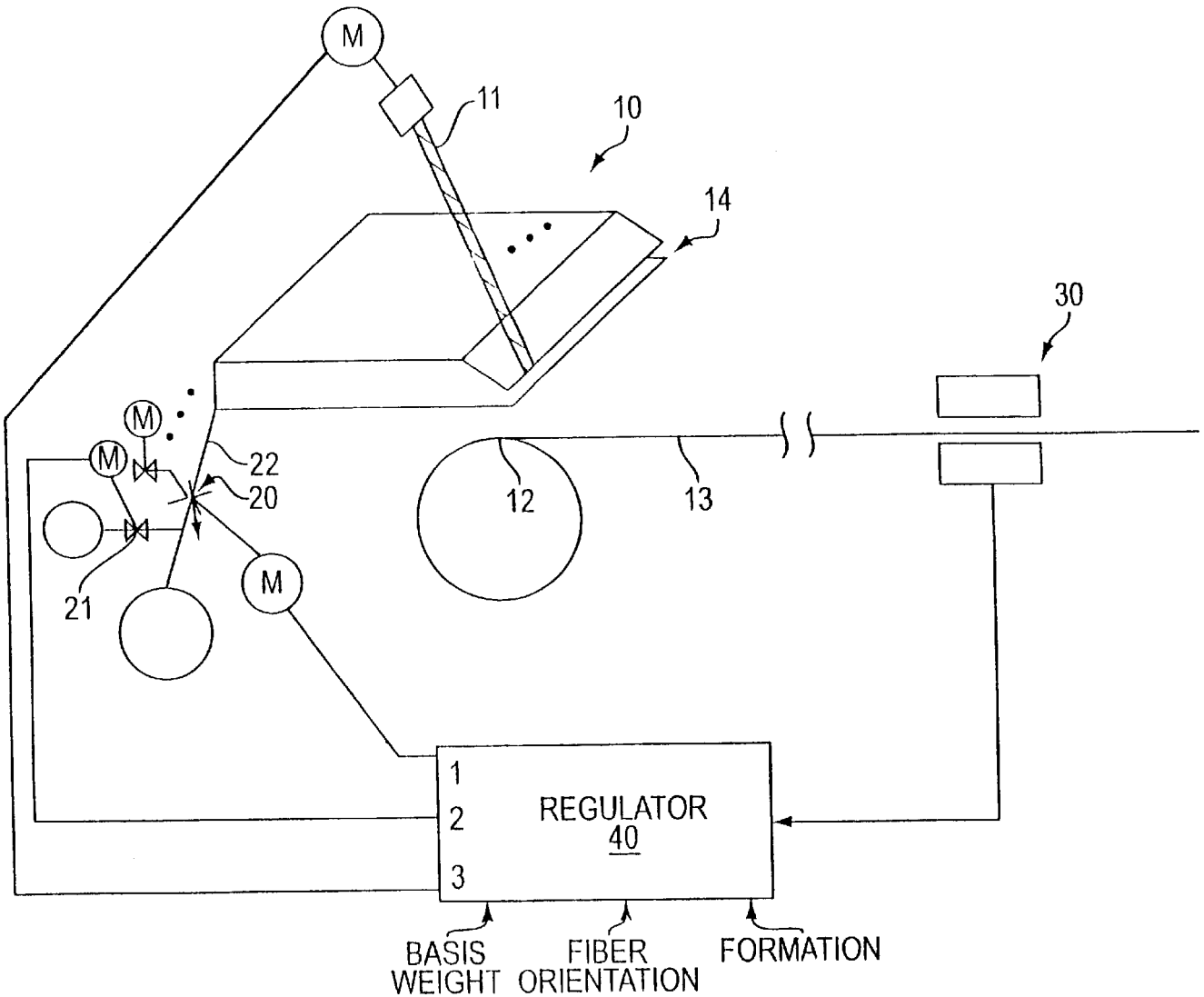
30
10
14
11
13
12
M
M
M
M
22
20
21
REGULATOR
40
1
2
3
FORMATION
FIBER ORIENTATION
BASIS WEIGHT

PROCESS FOR SETTING A UNIFORM CHARACTERISTIC CROSS-DIRECTION PROFILE FOR A PAPER WEB

CROSS-REFERENCE TO RELATED APPLICATIONS

The present application claims priority under 35 U.S.C. § 119 of German Patent Application No. 198 35 295.6, filed on Aug. 5, 1998, the disclosure of which is expressly incorporated by reference herein in its entirety.

BACKGROUND OF THE INVENTION

1. Field of the Invention

The present invention relates to a process for setting a uniform characteristic cross-direction profile for a paper web with regard to at least formation, basis weight, and fiber orientation in a paper machine via a headbox, in which consistency is sectionally adjusted and which has an adjustable die exit opening.

2. Discussion of Background Information

The Voith Sulzer publications "Module Jets®: the New Headbox for Independent Control of Cd Basis Weight and Fiber Orientation Profiles," p2919e, (March 1994); "Module Jet—erste Betriebserfahrungen mit dem neuen Stoffauflaufkonzept," Wochenblatt für Papierfabrikation 122, No. 12, pages 485–491 (1994), and "Stoffdichteabhängige Querprofilregelung—Betriebserfahrungen," Das Papier, volume 49, issue 10A, pages V99–V105 (1995) disclose the state of the art with regard to the process generally discussed above, and the disclosures of these documents are expressly incorporated by reference herein in their entireties.

From the above-noted publications, it is known to locally adjust the amount of solid matter deposited by an appropriate mixing of pulp slurry and a dilution liquid, eg., backwater, to reduce basis weight irregularities in a consistency-regulated headbox. It is further disclosed that the cross flow can be adjusted, and, therefore, the fiber cross-direction profile can be improved, by adjusting the sectional flow rate of pulp slurry at the die exit opening. These documents seek to achieve as even a flow across or over the screen at the die exit opening as possible. Moreover, it is assumed that there is a connection or relationship between the specific pulp slurry flow rate (measured in liters per meter of machine width) deposited at the headbox and the formation cross-direction profile, especially in twin wire formers.

Therefore, in the state of the art, problems arise in providing a process for operating a headbox, which maintains the known good quality of the basis weight cross-direction profile and the fiber orientation cross-direction profile that can be achieved by a consistency-regulated headbox and simultaneously has a positive influence on the fiber orientation cross-direction profile.

SUMMARY OF THE INVENTION

The present invention does not suffer from the above-noted drawbacks of the prior art.

Accordingly, the present invention relates to a process for setting a uniform characteristic cross-direction profile for a paper web with regard to at least formation, basis weight, and fiber orientation in a paper machine. The paper machine can include a headbox with an adjustable die exit opening and within which the consistency is sectionally adjustable. The process includes measuring and setting a desired basis weight cross-direction profile by adjusting the sectional consistency in the headbox, adjusting the formation cross-direction profile by adjusting a sectional, specific pulp slurry flow rate at the die exit opening, and one of enlarging the die exit opening at positions along a width of the paper machine in which a pulp slurry flow rate is higher than in other positions along the width of the paper machine and increasing the pulp slurry flow rate for positions along the width at which the die exit opening is larger than at other positions along the width. In this manner, a desired fiber orientation cross-direction profile is attained.

In accordance with a feature of the present invention, the adjustment of the formation cross-direction profile may be performed subsequently to the measuring and setting of the desired basis weight cross-direction profile.

According to another feature of the present invention, the one of enlarging the die exit and increasing the pulp slurry flow rate can be performed one of subsequently to and simultaneously with, adjustment of the formation cross-direction profile.

According to still another feature of the instant invention, the process can further include changing the die exit opening proportionally to a change in the pulp slurry flow rate associated with the position of the die exit opening.

In accordance with a further feature of the present invention, the change in the die exit opening may provide a desired speed cross-direction profile at the die exit opening after adjustment.

According to a still further feature of the instant invention, the paper machine can also including a control device that executes a control loop to perform at least one of the measuring and setting a desired basis weight cross-direction profile, adjusting the formation cross-direction profile, and one of enlarging the die exit opening and increasing the pulp slurry flow rate.

According to another feature of the present invention, the process may further include introducing chemicals to at least one of slow down and speed up the dewatering process. Further, the chemicals may be introduced in an edge area.

According to still another feature of the present invention, the process may further include one of sectionally adding and removing liquid. In this manner, the adjustment of the pulp slurry flow rates in a respective section can be attained. Further, the one of the adding and removing of liquid can occur in a z-direction in the edge areas.

In accordance with a further feature of the instant invention, the process may further include adding filler in areas with a higher flow rate. Further, the adding of filler includes sectional addition of liquid.

According to yet another feature of the present invention, the process may be performed in combination with a twin wire former.

The present invention also relates to a process for controlling cross-direction profiles in an apparatus having a sectioned headbox and a die exit opening. The process includes adjusting a sectional pulp slurry flow rate at the die exit opening, whereby a formation cross-direction profile is adjusted, and one of (a) adjusting the a gap size of the die exit opening at positions across a width of the apparatus in accordance with the adjusted pulp slurry flow rate associated with the positions, and (b) adjusting the pulp slurry flow rate at positions across a width of the apparatus in accordance with a gap size of at least a portion of the die exit opening associated with the positions.

In accordance with a feature of the instant invention, after the adjustment of the sectional pulp slurry flow rate, the process includes measuring and setting a desired basis weight cross-direction profile by adjusting a sectional consistency in the sectioned headbox.

According to another feature of the present invention, the one of enlarging the die exit and increasing the pulp slurry flow rate can be performed one of subsequently to and simultaneously with, adjustment of the sectional pulp slurry rate.

According to still another feature of the invention, the process may further include changing the die exit opening proportionally to a change in the pulp slurry flow rate associated with the position of the die exit opening.

In accordance with a further feature of the present invention, the change in the die exit opening provides a desired speed cross-direction profile at the die exit opening after adjustment.

In accordance with a still further feature of the present invention, the apparatus may include at least one spindle coupled to the die exit opening, and the process can further include driving the at least one spindle to adjust the gap size of the die exit opening.

According to yet another feature of the instant invention, the apparatus may include spindles coupled across the width of the die exit opening, and the process can to further include individually driving the spindles to individually adjust respective gap sizes of the die exit opening.

Other exemplary embodiments and advantages of the present invention may be ascertained by reviewing the present disclosure and the accompanying drawing.

BRIEF DESCRIPTION OF THE DRAWING

The present invention is further described in the detailed description which follows, in reference to the noted plurality of drawings by way of non-limiting examples of exemplary embodiments of the present invention, and wherein:

The FIGURE illustrates an exemplary apparatus for performing the process of the present invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawing making apparent to those skilled in the art how the several forms of the present invention may be embodied in practice.

The exemplary apparatus illustrated in FIG. 1 can be utilized for performing the process of setting a uniform characteristic cross-direction profile for a fibrous web, e.g., a paper or cardboard web. A headbox 10 is shown arranged over a breast roll 12 to output pulp onto a wire former 13. Weadbox 10 includes an adjustable die exit opening 14, whereby the opening is adjustable, e.g., via a spindle 11. Spindle 11 can also be coupled to an adjusting motor provided to adjust the nozzle gap cross-direction profile, and, as a result, the fiber orientation cross-direction profile. A volume stream 22 is coupled to headbox 10, and an adjustable ring frame 20 is positioned in volume stream 22 to adjust the throughput cross-direction profile, and, as a result, the formation cross-direction profile. Also coupled to headbox 10 is a valve 21 for adjusting the basis weight cross-direction profile.

Downstream from headbox 10 is a measuring chamber 30 for measuring cross-direction profile. The measured cross-direction profile is then forwarded to a regulator 40 which is provided to regulate the basis weight cross-direction profile.

Regulator 40 also receives three set values for cross-direction profile, i.e., basis weight, fiber orientation, and formation. A first output of regulator 40 is coupled to a motor for driving valve 21, a second output of regulator 40 is coupled to a motor for adjusting adjustable ring frame 20, and a third output of regulator 40 is coupled to a motor for adjusting spindle 11.

It has been noted by the inventor that, if a pulp slurry layer is produced in the above-described known process with the aid of a headbox with sectional consistency regulation and volume flow regulation to have a uniform mass distribution viewed over the width of the machine, a defect in basis weight cross-direction profile can still occur due to uneven web shrinkage across the machine width. Especially large deviations in web shrinkage can occur in the edge areas of the paper web, where an especially large degree of shrinkage occurs. Because a mass which was originally evenly distributed pulls together into a smaller area in the course of the shrinkage, a greater basis weight occurs in the areas of larger shrinkage. To compensate for this shrinkage effect and to improve the basis weight cross-direction profile, the consistency in the headbox, in accordance with the process of the present invention, can be reduced while the volume flow of the pulp slurry is kept constant in these areas.

Because of the uneven consistency across the width, an unevenly high retention of the suspension occurs in the dewatering process on the screen or between two screens. This unevenness can be especially noticeable in twin wire formers. Because of the unevenness in retention, dewatering occurs with varying intensity over varying amounts of time. In areas of lower consistency, the water can be removed more quickly, leading to an earlier immobilization of the fibers in this area. As a result, crosswise to the machine direction, areas arise in which the fibers are immobilized earlier and other areas arise in which the immobilization of the fibers does not occur until later.

Because the formation-improving action of the dewatering elements only takes effect when immobilization of the fibers has not yet occurred, the dewatering elements do not have the same effect over the entire width of the machine. Instead, areas appear in which the dewatering elements are still effective because an immobilization of the fibers has not yet occurred and other areas appear in which immobilization has occurred too early and, therefore, a formation improvement can no longer be achieved by the dewatering elements. Because the dewatering in the edge areas of the web proceeds especially quickly, i.e., the formation-improving effect of the dewatering elements can no longer act on the fibers in the edge areas, the same dewatering elements can still have an effect on the middle portion of the web. In this manner, a difference in formation occurs, at least between the web edge and the web center.

In order to unify the moment of immobilization of the fibers described above, the present invention provides a process for setting a uniform characteristic cross-direction profile for a paper web in reference to, e.g., formation, basis weight and fiber orientation in a paper machine that includes headbox 10 in which consistency is sectionally adjusted (influenced) and which has an adjustable die exit opening 14. The process includes:

(A) Measuring and setting desired basis weight cross-direction profiles by influencing sectional consistency in the headbox;

(B) subsequently influencing the formation cross-direction profile by influencing the sectional, specific pulp slurry flow rate at the die exit opening; and (C) simultaneously or subsequently enlarging the die exit opening at points having a higher pulp slurry flow rate, and vice versa, to achieve a desired fiber orientation cross-direction profile.

The process of the present invention departs from the theory that has been dominant in the art up to now, i.e., that as uniform and specific pulp slurry flow rate as possible should be achieved over the width of the machine in a consistency-controlled headbox. In contrast, the process of the present invention intentionally causes an elevated, specific pulp slurry flow rate in the area of anticipated fiber immobilization. However, in order to maintain a desired and mainly even fiber orientation cross-direction profile, the specific pulp slurry flow can be coupled with the opening of the aperture of the headbox to maintain the speed cross-direction profile of the pulp slurry departing the headbox. This means that, in addition to a control element for the basis weight profile, a control element is also necessary at the headbox to adjust the sectional flow rate. With this kind of control element, the flow rate, e.g., in the edge regions, can be raised to the point that the formation cross-direction profile is even in the crosswise direction. This measure causes the points of immobility to be arranged in a line when viewed across the machine. If, during increased flow rate, the aperture opening is kept generally parallel, which is usually the case in consistency-regulated headboxes, cross flows will occur because the greater flow rate through the die opening in the edge areas will cause a greater loss of pressure than in the middle of the web. To prevent these cross flows, the die opening must be adjusted virtually proportionally to the change in flow rate. Thus, in the case of an increased flow rate in the edge area, the opening must be opened further in the edge area.

In contrast to the known process generally in use today, in which the headbox aperture is used for fiber orientation correction, the present invention describes a process that utilizes changes to the local volume flows to correct fiber orientation and to the aperture for optimizing formation.

It is understood that the desired cross-direction profiles will not necessarily always need to be uniform over the entire machine width, but rather could also have an especially advantageous non-linear course.

According to another embodiment of the process of the present invention, it may be preferable to change the die exit opening 14 in proportion to the change in the specific pulp slurry flow rate. An especially advantageous optimization of the exit opening is produced when the change in the die exit opening is undertaken in such a way that a desired and mainly constant speed cross-direction profile is present at the die exit opening after adjustment.

Further, it can be advantageous for at least one of the above-mentioned process steps to be incorporated as a control loop so that an automatic adjustment of the control elements occurs at the headbox.

Another advantageous embodiment of the process relates to a combination with the use of chemicals that adjusts the speed of dewatering, e.g., polyacrylamid PAA dosed through a large tube, a small tube, and/or sectional flows. In this way, a significant advantage can be attained in that influence can be exerted not only on the formation, but also simultaneously on the sheet composition. This is because of the way the linkage forces of the fine substances and the fillers affected by washing, out can be adjusted.

In accordance with this idea, it may be especially advantageous in areas with a relatively high flow rate to add filler, e.g., by sectionally providing liquid. It may be especially advantageous if the addition or removal of liquid takes place to adjust the specific pulp slurry flow rate in the z-direction in the edge areas of the headbox. In this manner, the upper or lower side of the sheet would also be significantly adjusted. In this regard, it is noted that, while the goal of regulation is to even out the cross-direction profiles of basis weight, fiber orientation, formation, and filler content, filler cross-direction profile is not necessarily improved via regulator 40. Accordingly, it is recommended that filler be added separately, particularly in the edge regions. Accordingly, the upper and lower sides of the sheet can be influenced by adding, filler in the outer layers.

The process described above can be used in any known construction of a wet section of a paper machine, however, it can be especially advantageous when utilized with twin wire formers because the influence on the formation can be especially pronounced in twin wire formers.

In a particular example, a material density may be 0.95% in the edge regions and 1% in the center region, whereby shrinkage compensation can be observed. Further, a volume stream of 10,800 l/min per meter in both the edge and center region provides for an even water line. A gap opening of the die exit opening in the edge region can be 10.8 mm and in the center region, the opening can be 10 mm. In this manner, a prevention of crosswise streams may be observed.

It is noted that the foregoing examples have been provided merely for the purpose of explanation and are in no way to be construed as limiting of the present invention. In particular, the disclosed elements and features of the process can be utilized not only in the combinations described in the exemplary embodiment, but also alone or in other combinations without departing from the scope of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for setting a uniform characteristic cross-direction profile for a paper web with regard to at least formation, basis weight, and fiber orientation in a paper machine, the paper machine including a headbox with an adjustable die exit opening and within which the consistency is sectionally adjustable, the process comprising:

measuring and setting a desired basis weight cross-direction profile by adjusting the sectional consistency in the headbox;

adjusting the formation cross-direction profile by adjusting a sectional, specific pulp slurry flow rate at the die exit opening; and one of:

enlarging the die exit opening at positions along a width of the paper machine in which a pulp slurry flow rate is higher than in other positions along the width of the paper machine; and increasing the pulp slurry flow rate for positions along the width at which the die exit opening is larger than at other positions along the width, thereby attaining a desired fiber orientation cross-direction profile.

2. The process in accordance with claim 1, wherein the adjustment of the formation cross-direction profile is performed subsequently to the measuring and setting of the desired basis weight cross-direction profile.

3. The process in accordance with claim 1, wherein the one of enlarging the die exit and increasing the pulp slurry flow rate is performed one of subsequently to and simultaneously with, adjustment of the formation cross-direction profile.

4. The process in accordance with claim 1, further comprising changing the die exit opening proportionally to a change in the pulp slurry flow rate associated with the position of the die exit opening.

5. The process in accordance with claim 1, wherein the change in the die exit opening provides a desired speed cross-direction profile at the die exit opening after adjustment.

6. The process in accordance with claim 1, wherein the paper machine further including a control device that executes a control loop to perform at least one of the measuring and setting a desired basis weight cross-direction profile, adjusting the formation cross-direction profile, and one of enlarging the die exit opening and increasing the pulp slurry flow rate.

7. The process in accordance with claim 1, further comprising introducing chemicals to at least one of slow down and speed up the dewatering process.

8. The process in accordance with claim 7, wherein the chemicals are introduced in an edge area.

9. The process in accordance with claim 1, further comprising one of sectionally adding and removing liquid, whereby the adjustment of the pulp slurry flow rates in respective section is attained.

10. The process in accordance with claim 9, wherein the one of the adding and removing of liquid occurs in a z-direction in the edge areas.

11. The process in accordance with claim 1, further comprising adding filler in areas with a higher flow rate.

12. The process in accordance with claim 11, wherein the adding of filler includes sectional addition of liquid.

13. The process in accordance with claim 1 being performed in combination with a twin wire former.

14. A process for controlling cross-direction profiles in an apparatus having a sectioned headbox and a die exit opening, the process comprising:

adjusting a sectional pulp slurry flow rate at the die exit opening, whereby a formation cross-direction profile is adjusted; and one of:

adjusting the a gap size of the die exit opening at positions across a width of the apparatus in accordance with the adjusted pulp slurry flow rate associated with the positions; and adjusting the pulp slurry flow rate at positions across a width of the apparatus in accordance with a gap size of at least a portion of the die exit opening associated with the positions.

15. The process in accordance with claim 14, after the adjustment of the sectional pulp slurry flow rate, measuring and setting a desired basis weight cross-direction profile by adjusting a sectional consistency in the sectioned headbox.

16. The process in accordance with claim 14, wherein the one of enlarging the die exit and increasing the pulp slurry flow rate is performed one of subsequently to and simultaneously with, adjustment of the sectional pulp slurry rate.

17. The process in accordance with claim 14, further comprising changing the die exit opening proportionally to a change in the pulp slurry flow rate associated with the position of the die exit opening.

18. The process in accordance with claim 14, wherein the change in the die exit opening provides a desired speed cross-direction profile at the die exit opening after adjustment.

19. The process in accordance with claim 14, wherein the apparatus includes at least one spindle coupled to the die exit opening, and the process further comprises:

driving the at least one spindle to adjust the gap size of the die exit opening.

20. The process in accordance with claim 14, wherein the apparatus includes spindles coupled across the width of the die exit opening, and the process further comprises:

individually diving the spindles to individually adjust respective gap sizes of the die exit opening.

* * * * *